US005548374A

United States Patent [19]

Iguchi et al.

[11] Patent Number: 5,548,374

[45] Date of Patent: Aug. 20, 1996

[54] IMAGE FORMING APPARATUS USING A PROCESS UNIT

[75] Inventors: Michihisa Iguchi; Yukio Tsuda, both of Tokyo, Japan

[73] Assignee: Kabushiki Kaisha Toshiba, Kawasaki, Japan

[21] Appl. No.: 467,516

[22] Filed: Jun. 7, 1995

Related U.S. Application Data

[63] Continuation of Ser. No. 412,083, Mar. 27, 1995, abandoned, which is a continuation of Ser. No. 80,207, Jun. 23, 1993, abandoned.

[30] Foreign Application Priority Data

Jun. 24, 1992 [JP] Japan ..... 4-165588

[51] Int. Cl.[6] ..... G03G 21/00; G03G 15/00

[52] U.S. Cl. ..... 355/200; 355/206; 355/208; 355/210; 355/246

[58] Field of Search ..... 355/755

[56] References Cited

U.S. PATENT DOCUMENTS

| | | | |
|---|---|---|---|
| 4,032,227 | 6/1977 | Hubbard et al. | 355/246 X |
| 4,551,000 | 11/1985 | Kanemitsu et al. | 355/210 |
| 4,575,221 | 3/1986 | Onoda et al. | 355/200 |
| 4,707,748 | 11/1987 | Ohtsuka et al. | 355/209 X |
| 4,771,313 | 9/1988 | Kuroda et al. | 355/203 X |
| 4,961,088 | 10/1990 | Gilliland et al. | 355/206 |
| 4,974,020 | 11/1990 | Takamatsu et al. | 355/208 |
| 5,008,711 | 4/1991 | Sakamoto et al. | 355/206 |
| 5,105,219 | 4/1992 | Yoshikado | 355/206 |
| 5,155,527 | 10/1992 | Gokita et al. | 355/204 |
| 5,200,779 | 4/1993 | Nawata | 355/206 |
| 5,206,685 | 4/1993 | Hara et al. | 355/206 |
| 5,227,847 | 7/1993 | Motohashi et al. | 355/246 X |

FOREIGN PATENT DOCUMENTS

| | | |
|---|---|---|
| 1-41986 | 9/1989 | Japan . |
| 1-41985 | 9/1989 | Japan . |
| 3-56474 | 8/1991 | Japan . |

*Primary Examiner*—Matthew S. Smith

*Attorney, Agent, or Firm*—Finnegan, Henderson, Farabow, Garrett & Dunner, L.L.P.

[57] ABSTRACT

In a recording apparatus for performing electro-static recording using toner, an image forming apparatus has a process unit including, as one unit, at least a photosensitive member and a spent toner holding section, a first counter for counting a total amount of use of the photosensitive member and a second counter for counting a total amount of toner that has been consumed. A determining section using the process unit determines the necessity for the process unit to be replaced with a new process unit by comparing a total amount of use of the photosensitive member counted by the first counter with a first predetermined reference value and the total amount of consumed toner with a second predetermined reference reference value according to whether the total amount of use of the photosensitive member exceeds the first reference value or the total amount of toner counted exceeds the second reference value.

20 Claims, 6 Drawing Sheets

IMAGE FORMING APPARATUS USING A PROCESS UNIT

This application is a continuation of application Ser. No. 08/412,083 filed Mar. 27, 1995, now abandoned, which is a continuation of application Ser. No. 08/080,207 filed Jun. 23, 1993, abandoned.

BACKGROUND OF THE INVENTION

1. Field of the Invention

The present invention relates to an image forming apparatus utilized for electrostatic recording, electro-static printing, etc., on an electrophotographic type recording apparatus, etc.

2. Description of the Related Art

In an image forming apparatus for forming a toner image, by a predetermined processing, on a recording sheet or other transfer media, in an electrophotographic type recording apparatus represented by, for example, a facsimile machine, a photosensitive member on the surface of a photosensitive drum contained in the apparatus encounters a repeated electrostatic image forming action and mechanical stress by a cleaning blade, etc., accompanied by a repeated cleaning action. This photosensitive member is normally shorter in service life than other component parts and, from the standpoint of operation, it becomes necessary to replace it with a new photosensitive member after a predetermined life limit, such as a service life, is reached.

For example, JP3-56474 (CANON case), JP1-41985 (CANON case) and JP1-41986 (CANON case) are known as the existing documents associated with the technique as set out above and have the following problems.

The electrophotographic type recording apparatus of today is often of such a type that the user can readily replace the photosensitive member with a new one and that, for ease in maintenance, the photosensitive drum together with the associated disposable component parts such as a charger, developing unit and cleaner, are provided as a combined unit (i.e. a process unit) in the apparatus. Further, these disposable component parts together with the photosensitive member are often of such an integral type that they can be replaced all at a time with a new unit. This integral unit enables the user to replace the disposable component parts with new ones by replacing the process unit. This ensures a readier maintenance operation. A toner is sealed in a hopper for holding it for development (i.e. a toner sealing type). Further, since a spent toner produced at the cleaning operation by a cleaner is held in its own container, the user can readily handle the toner.

In the toner-sealed type process unit as set out above, an amount of toner to be used is restricted to a given extent and, if a black area, i.e., an image area, on a recording sheet is greater, upon recording, than a white background of the sheet, that is, if a black rate is higher on the sheet, the toner is earlier consumed to an empty level before the photosensitive member reaches its own predetermined service life limit, thus substantially hastening the replacement of the process unit as a whole. Therefore, the photosensitive member still retaining its own effective service life has to be thrown away by the disposal of the process unit and hence the running cost on the apparatus is increased, resulting in an economical disadvantage.

In order to eliminate such a disadvantage, an addition arrangement, for example, is utilized to enable an additional supply of toner to be made to a hopper for holding a fresh toner therein, so that the supply of the toner can be continued until the photosensitive member finally reaches its own service life limit. By so doing it is possible to secure an optimal service life of the process unit. In the above described type of process unit, the replacement time of the process unit is set based on a given cumulative value corresponding to the number of printing cycles of the photosensitive member. Put in another way, the suitable replacement time of the process unit is determined to be in order when a predetermined number of sheets are printed. In the case where the amount of toner reaches a deficient level before a given printing number, it is possible for the user to make an additional supply of toner to the hopper as desired. This type of apparatus enables the user to utilize the process unit to a maximum possible limit of use until the photosensitive member reaches its own available service life limit.

Since, in this case, a spent toner holding section for collecting a spent toner is constant in its capacity, that type of apparatus involves the following disadvantage. Generally an amount of spent toner is increased in proportion to the amount of fresh toner supplied and, when a higher black rate is involved, more fresh toner is used to form images on the sheet. If such a higher black rate occurs many times upon printing, the spent toner holding section is nearly overflowed with the spent toner until the photosensitive member reaches its own given life limit. As a result, the spent toner is overflowed out of the spent toner holding section or clogged at some places on a drive system, there being a risk that the drive system is locked or fails. It may be considered that, in order to avoid such a problem, an overflow sensor must be provided so as to inform the user that the spent toner holding section is nearly overflowed with the spent toner or the spent toner holding section is made somewhat larger than normal while leaving some margin in the spent toner holding section. The spent toner holding section having such a large margin makes the process unit bigger. And in the case a sensor for detecting the filling of the spent toner is arranged, when the images are recorded many times on the recording sheet at a lower black rate, that is, at a higher white rate, the photosensitive member reaches its own given life limit before the spent toner holding section is detected to be filled with the spent toner.

In the aforementioned apparatus, since the life limit (i.e., a service life), of the process unit per se is set in accordance with a given service life limit period of the photosensitive member, if an image is often printed at a higher black rate against a white background on the sheet, there is a possibility that the spent toner holding section will be fully filled with the spent toner before the process unit reaches its own life limit. It is considered that, in order to prevent such a situation, an overflow sensor is provided on the spent toner holding section or the spent toner holding section is made somewhat large. Upon frequent printing of images at a high white rate on the sheet a problem has been encountered that the photosensitive member of the process unit reaches its own life limit before the spent toner holding section is detected to be fully filled with the spent toner. Therefore, the above-described situation, is impractical.

SUMMARY OF THE INVENTION

It is accordingly the object of the present invention to provide an image forming apparatus which, without the need to use any bulklet, high-priced unit per se, can initially prevent a spent toner holder from being fully filled with a spent toner and can utilize a remaining toner and photosensitive member to a maximum possible extent.

According to the present invention, there is provided an image forming apparatus comprising:

a process unit including, detachably mounted on the body of the apparatus, a photosensitive member and a spent toner holder;

a first counter for counting a first total amount of use of the photosensitive member;

a second counter for counting a second total amount of toner has been consumed; and a determining section for comparing the first total amount of use with a first predetermined reference value and the second total amount with a second predetermined reference value and for informing a user when the counted total rotation number matches the first reference value or the total amount of consumed toner matches the second reference value.

According to the present invention it is possible to obtain the following advantages. To be specific, the first counter counts the total number of use of the photosensitive member and the determining section determines the necessity for the process unit to be replaced with a new process unit according to whether the total rotation number as set out above matches the first reference value or the total amount of consumed toner as set out above matches the second reference value.

The amount of spent toner is substantially in proportion to the amount of toner consumed. Therefore, it is possible to estimate the amount of consumed toner from the amount of spent toner collected at and, up to a capacity of, the spent toner holder. Thus it is possible to estimate that the spent toner holder has been nearly fully filled with the spent toner on the recognition that the total amount of toner has been consumed matches the second reference value. Even before the photosensitive member reaches its given life limit, that is, the total rotation number with which the photosensitive member is used is smaller than the first reference value, it is possible to determine the necessity for the process unit to be replaced with a new process unit. Since the amount of toner can be readily detected through the utilization of any existing detector, such as a toner sensor, so, it is not necessary to provide any specially-designed detector for toner detection.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
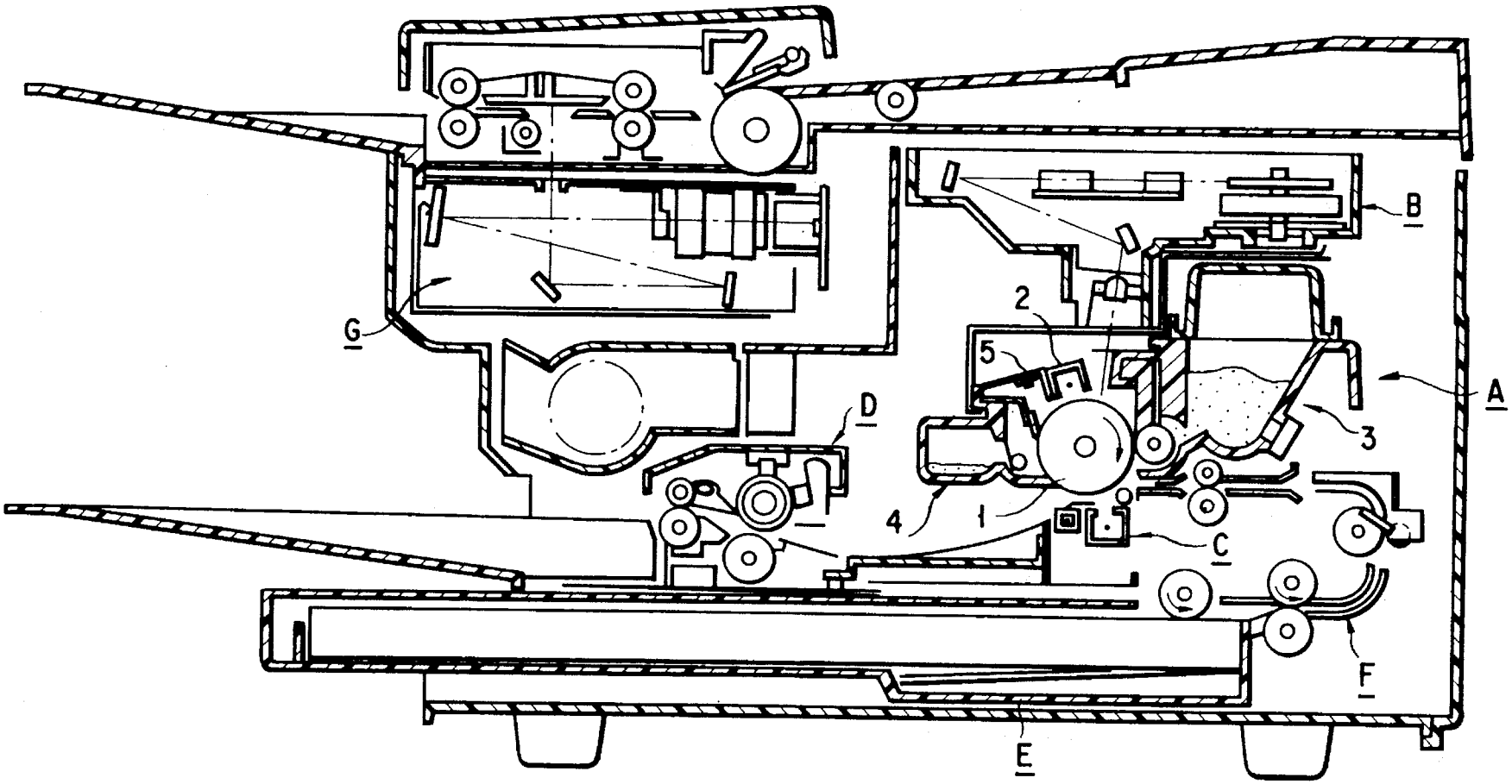
FIG. 1 is a cross-sectional view showing a general arrangement of an image forming apparatus according to one embodiment of the present invention.

FIG. 1 is a cross-sectional view generally showing an arrangement of a facsimile machine to which an image forming apparatus according to the present invention is applied. Put it in another way, the facsimile machine comprises a process unit A, an exposure unit B, a transfer unit C, a fixing unit D, a sheet cassette E, a sheet supply mechanism section F and a transmit mechanism section G. The process unit A is comprised of an integral unit including a photosensitive drum 1 equipped with a photosensitive member, a charger 2, a developing unit 3, a cleaning unit 4 and a discharger 6 as will be set out in more detail in connection with FIG. 2. In this arrangement, a toner image is formed on a photosensitive drum by a Carlson process. The process unit A is detachably mounted on the facsimile equipment body.

The exposure unit B subjects the photosensitive member to an exposure to form an electrostatic latent image thereon. The transfer unit C transfers a toner image which is formed on the photosensitive member to a recording sheet supplied by a sheet supply mechanism section F from the sheet cassette E. The fixing unit D fixes the toner image which is transferred to the recording sheet to be fixed for stability.

The transmit mechanism section G optically reads out a document image, etc., for transmission to a remote site and generates an image signal through a photoelectric conversion.

Figure 2:
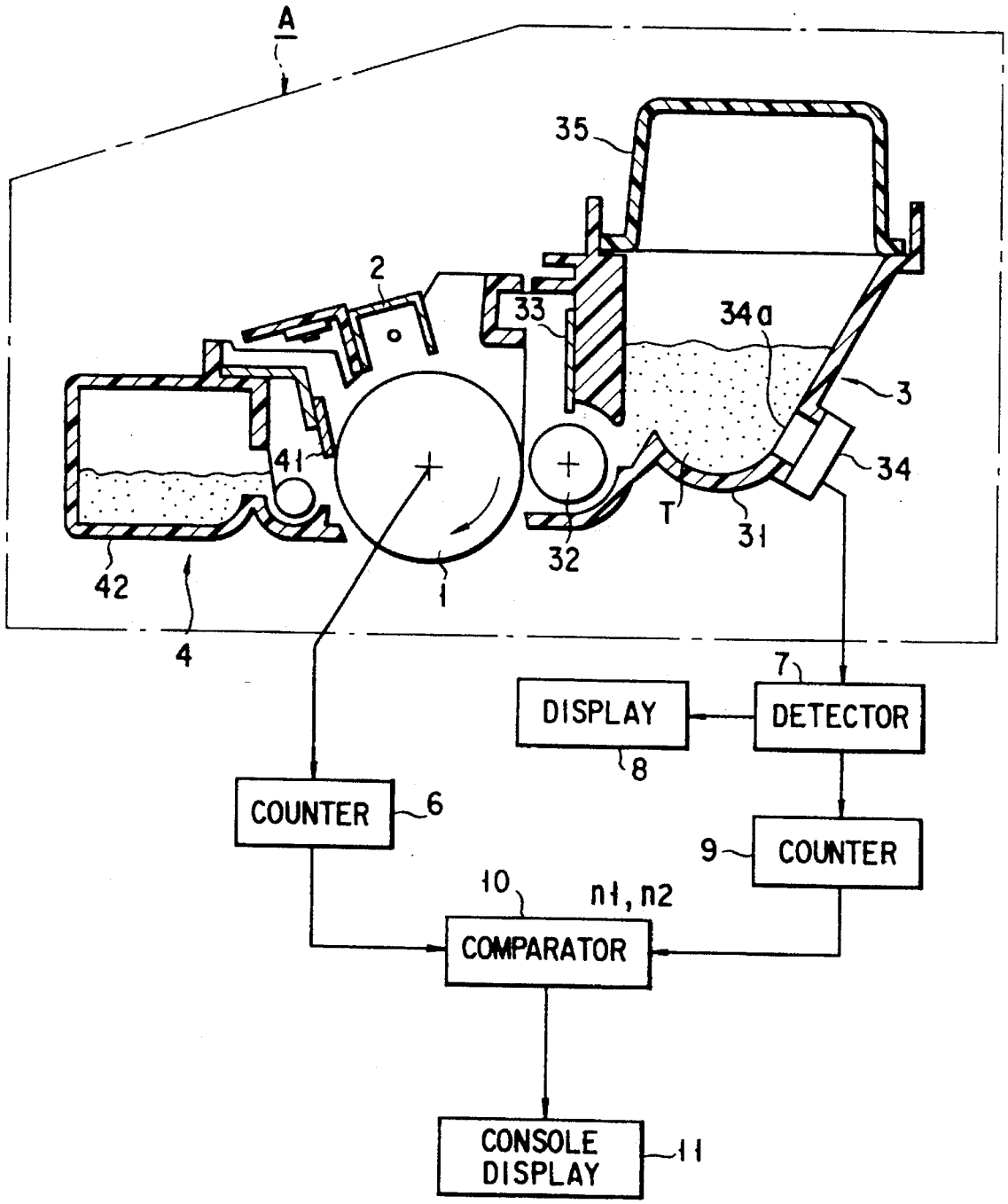
FIG. 2 is a cross-sectional view showing a process unit in FIG. 1 as well as a block diagram of an electric system associated with the process unit.
Figure 3:
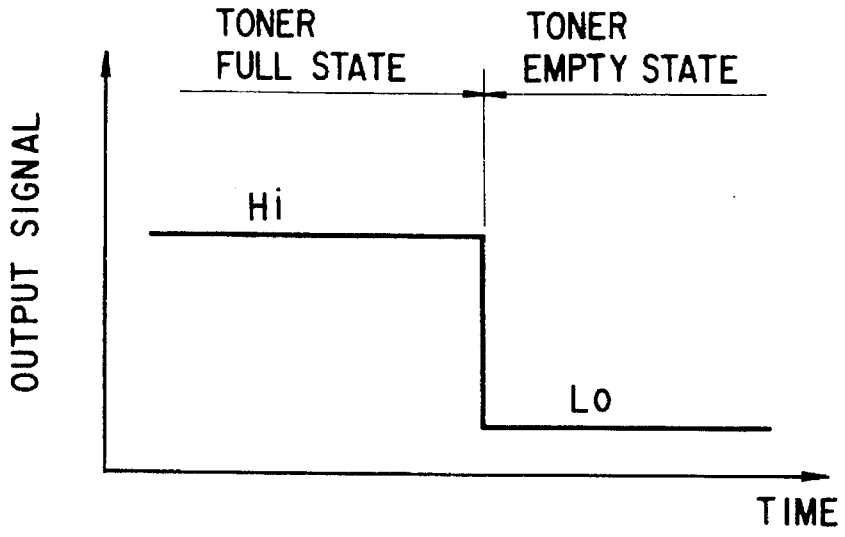
FIG. 3 is a graph for explaining the state of an output signal of a detector 7 in FIG. 2.

FIG. 2 shows, in full, a function block arrangement of an electric system circuit connected to a process unit A and its body, noting that the same reference numerals are employed to designate parts or elements corresponding to those shown in FIG. 1.

The photosensitive member of the photosensitive drum 1 has its surface uniformly coated with a photosensitive conductive material and is rotated by a drive transmission mechanism (not shown) in a direction as indicated by an arrow in FIG. 2.

The charger 2, developing unit 3, cleaning unit 4 and discharger 5 are arranged around the outer periphery of the photosensitive drum 1 and provide an integral unit as one process unit A when being combined together.

A cylindrical developing roller 32 is arranged in the developing unit 3 at an opening zone of a hopper 31 with part of the roller 32 located in the hopper. A blade 33 in FIG. 2 maintains at all times constant an amount of toner T which is fed to an outside of the hopper 31 while being carried on the developing roller. At that time, the blade is triboelectrically contacted with the toner T. A toner sensor 34 has its sensor surface 34*a* located opposite the toner side in the neighborhood of the bottom section of the hopper 31. The toner sensor 34 imparts a high-frequency oscillation to, for example, a piezoelectric element and detects a variation in the amplitude of the sensor surface 34*a* resulting from the presence or absence of the toner on the sensor surface 34*a*.

A toner cartridge 35 is detachably mounted at a top opening of the hopper 31.

The cleaning unit 4 is set in contact with the photosensitive drum 1 and comprises a cleaning blade 41 for scraping away a toner deposited on the surface of the photosensitive member and a spent toner holding section 42 for collecting the toner scrapped away by the cleaning blade 41.

A counter 6 counts the number of rotations of the photosensitive drum 1 and delivers a result of counting to a comparator 10 as will be set out below. A detector 7 detects the presence or absence of the toner on the basis of the amplitude variation of the sensor surface 34*a* of the toner sensor 34 and delivers a result to a counter 9 as will be set out below. Based on the result of detection obtained at the detector 7 a display 8 displays a state of toner deficiency as required, prompting the user to supply an additional toner to the hopper. Based on the state change of a detection signal obtained by the detector 7 the counter 9 counts the number of times a toner is additionally supplied to the hopper.

The comparator 10 compares the count value of the counter 6 with a first predetermined reference value nl and the count value of the counter 9 with a second predetermined reference value n2. The first reference value n1 is set to a value corresponding to the time period over which the photosensitive drum 1 can exhibit a predetermined performance. Generally, for in this case, the total amount of use of the photosensitive member can be regarded as being in proportion to the number of rotations of the drum and hence the available life limit of the drum can be expressed as a limit on the rotation number of the drum. The second reference value n2 is set to a value corresponding to an amount of toner with which a spent toner is fully filled in the spent toner holding section 42 in the cleaning unit 4. In general, an amount of toner spent can be regarded as being substantially proportional to an amount of fresh toner used, that is, an amount of toner consumed relative to the hopper 31, and that amount of toner consumed is proportional to a total amount of toner supplied to the hopper 31 provided that an amount of toner remaining in the hopper 31 is fixed, In the present apparatus in which one toner supply level is fixed, a total amount of toner supplied to the hopper is in proportion to the number of times the toner is supplied and hence an amount of spent toner collected at the spent toner holding section 42 can be expressed as the number of times the toner is supplied to the hopper.

Based on the result of comparison obtained by the comparator 10 a console display 11 warns the user, as required, that the process unit A be replaced with a new process unit (not shown).

It is to be noted that the counters 6 and 9, detector 7, displays 8 and 11 and comparator 10 as set out above are arranged on the body side of the facsimile equipment where the process unit A is used.

An operation on the service life limit monitoring of the process unit A in the facsimile equipment thus arranged will be explained below.

First the counter 6 counts the reference pulse signals of a step motor, not shown, serving as a drive source for rotationally driving the photosensitive drum 1 and, by so doing, counts the number of times the photosensitive drum 1 is rotated.

Figure 4:
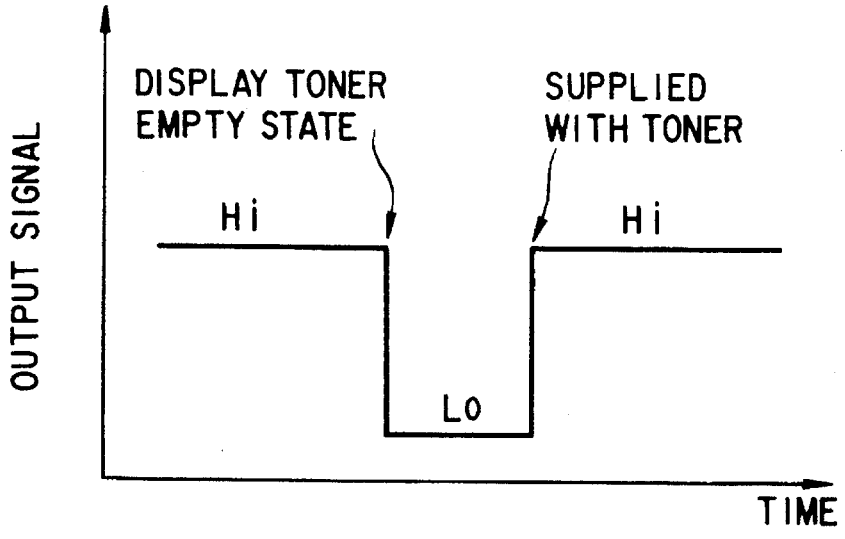
FIG. 4 is a graph showing a relation of a toner supply time to an output signal generated at that time.

The counter 9 counts the number of times a toner T is newly supplied to the hopper 31. This counting operation is performed, in the following sequence, based on the result of detection by the toner sensor 34 and detector 7. To be specific, the detector 7 delivers a "Hi"-level signal for a toner full state or a "Lo"-level signal for a toner empty state, that is, a predetermined signal representing their state. When a toner T is supplied to the hopper 31 after the output signal of the detector 7 has been varied to the "Lo"-level due to a toner empty state involved, the output signal of the detector 7 has been changed from the "Lo"-level to the "Hi"-level as shown in FIG. 4, that is, delivers a predetermined signal representing a corresponding state. Therefore, the counter 9 has its count value increased one increment in synchronization with a rising edge of the output signal of the detector 7 in which case the increment represents a count value showing the number of times a toner is supplied.

The supplying of the toner to the hopper 31 is carried out in the following way. To be specific, the toner cartridge 35 is comprised of a hollow box opened at one surface of the cartridge, i.e., on the mount side of the hopper 31. Prior to being mounted over the hopper 31 the toner cartridge has its opening closed by a tear-seal with a given amount of toner T sealed in the cartridge. The user can mount the toner cartridge 35 over the hopper 31, by manually tearing the seal, so that the toner T is dropped from the cartridge 35 to the bottom of the hopper 31 and stored in the hopper. When the output signal of the detector 7 becomes a "Lo"-level, the display 8 displays a toner empty state, prompting the user to supply an additional toner to the hopper. After confirming this display, the user can replace, for example, the toner cartridge with a new one in accordance with the steps as set out above so as to supply an additional toner to the hopper.

Figure 5:
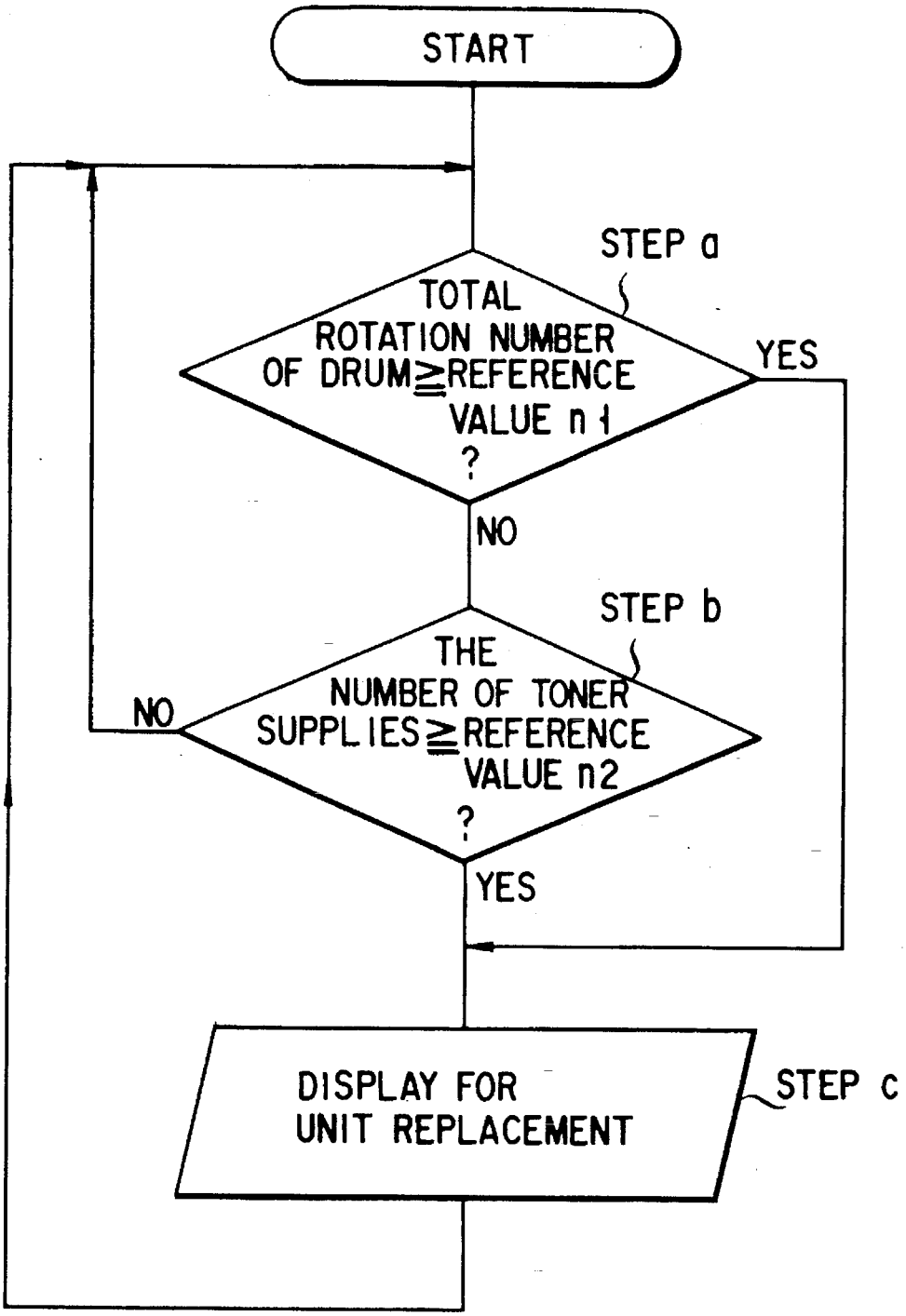
FIG. 5 is a flow chart for explaining the process of steps and determination by a comparator in FIG. 2.

As shown in FIG. 5, while a recording operation is done, the comparator 10 monitors the count value (i.e. a total rotation number of the photosensitive drum) of the counter 6 to see whether or not it matches the first reference value n1 and, in addition, the comparator 10 also monitors the count value (i.e. the toner supply number) of the counter 9 to see whether or not it matches the second reference value n2 (cf. steps a and b).

When the count value of the counter 6 matches the first reference value n1 or the count value of the counter 9 matches the second reference value n2, the comparator 10 determines that the process unit A has reached its given life limit, and enables the console display 11 to display a corresponding state thereon, prompting the user to replace the process unit A with a new one (cf. step c).

Since the first reference value n1 is set to a value corresponding to the service life limit of the photosensitive drum 1 as set out above, the comparator can determine that, when the count value of the counter 6 matches the first reference value n1, the photosensitive drum has reached its own life limit. On the other hand, the second reference value n2 is set to a predetermined value corresponding to an amount of toner, as set out above, with which the spent toner holding section 42 is nearly fully filled. Therefore, the comparator can determine that, when the count value of the counter 9 matches the second reference value n2, the spent toner holding section 42 has been nearly fully filled with the spent toner (that is, a margin space is left in the spent toner holding section 42). Either when the count value of the counter 6 matches the first reference value n1 or when the count value of the counter 9 matches the second reference value n2, the comparator 10 serving as a determining means determines that the process unit A has reached its own life limit, and enables the console display 11 to display a given display, thus prompting the user to replace the process unit A with a new one (step c).

According to the present embodiment, based on the number of times the toner T is supplied to the hopper 31 an estimation is made on whether or not the spent toner holding section 42 is nearly fully filled with the spent toner collected. If the spent toner holding section 42 is nearly fully filled with the spent toner even prior to the photosensitive drum 1 reaching its own life limit, the comparator determines that the process unit A has reached its own life limit, and enables the console display 11 to display a state thereon representing that the process unit A be replaced with a new process unit. Thus, the user can recognize the necessity for the process unit A to be promptly replaced with a new one. It is, thus, possible to prevent the process unit A from continuing being used with the spent toner holding section 42 nearly fully filled with the spent toner. Even if, therefore, the spent toner holding section 42 is not so formed as to have a more-than-necessary space, it is possible to prevent a drive system from being locked due to clogging of an overflowed toner in the spent toner holding section 42, etc. Since, when a determination is made on whether or not the spent toner holding section is nearly fully filled with the spent toner, an estimation is made based on the number of toner supplies to the hopper 31. So, it may be possible to use the toner sensor 34 adopted in the conventional apparatus. Further, it is not necessary to arrange a new specific sensor relative to the spent toner holding section 42 or the developing unit. Such an arrangement entails no added cost.

Furthermore, according to the present invention, when relatively less toner is consumed upon recording an image at a higher white level on the recording sheet and hence less spent toner is involved, the number of rotations of the photosensitive member is checked in the present invention. Therefore, it is possible to previously prevent the photosensitive member from reaching its given life service limit prior to the spent toner holding section being nearly fully filled with the spent toner.

As set out above, the present embodiment can achieve an unexpected advantage on the recognition that there are at least two factors (e.g. the total rotation number of the photosensitive member with the drum and a total amount of toner has been consumed) and that the factors can be utilized collectively as a standard on which the life limit of the process unit is determined.

The present invention is not restricted to the aforementioned embodiment.

Figure 6:
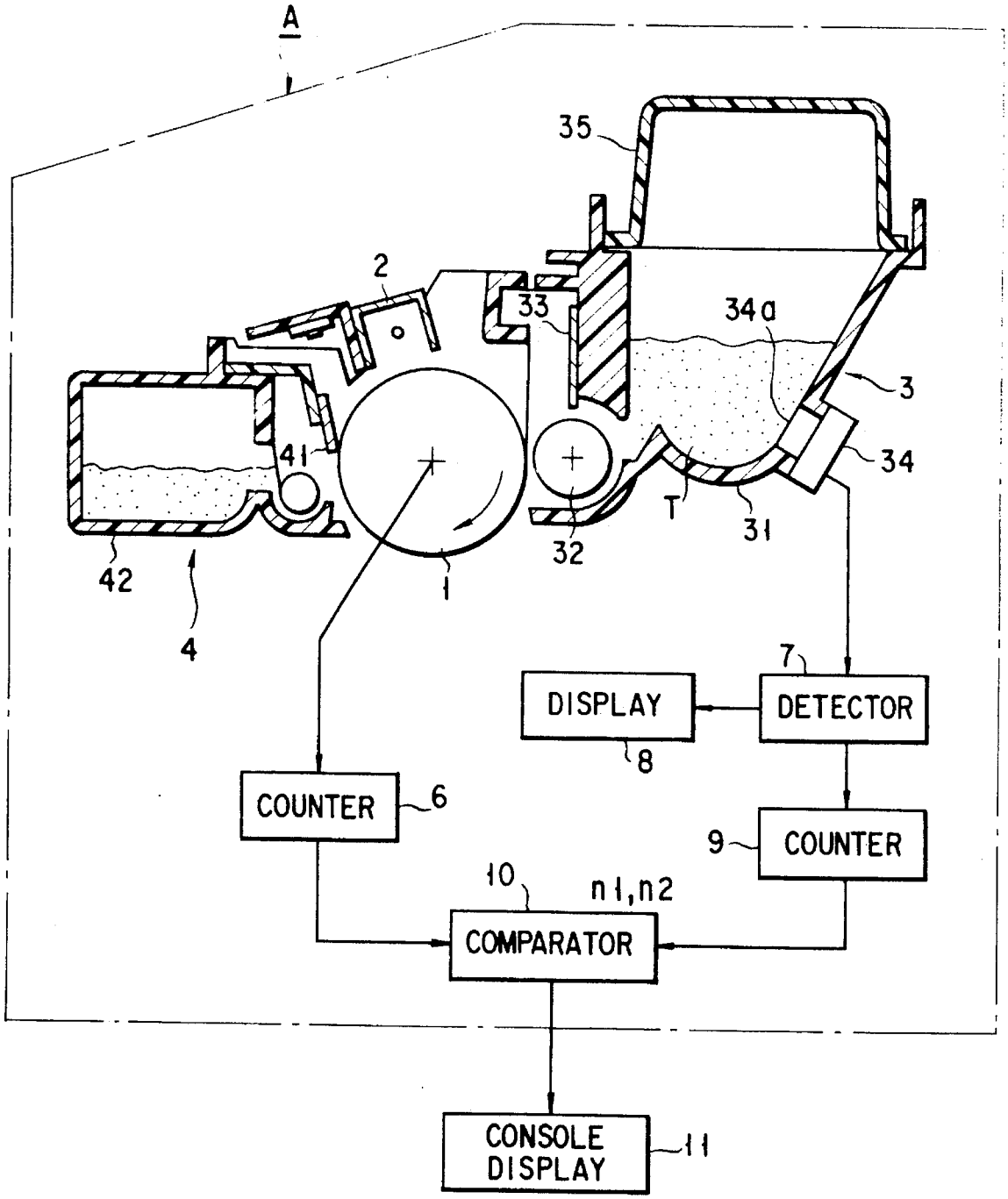
FIG. 6 shows a modified form of the image forming apparatus according to the present invention.

FIG. 6 shows a modified form of the aforementioned embodiment. As shown in the previous embodiment, a counter 6, detector 7, display 8, counter 9, comparator 10 and console display 11 are provided all on the assembly side of a recording apparatus separate from a process unit A. If all these component parts except for the display are both inexpensive and disposable, then they may be integrally mounted as a process unit A as shown in FIG. 6. To be specific, the counter 6 is arranged, for example, near a rotation shaft of a photosensitive drum. The counter 9 and associated component parts such as the detector 7 and comparator 10, as well as at least the display 8, may be provided as integral component parts in the process unit A.

Figure 7:
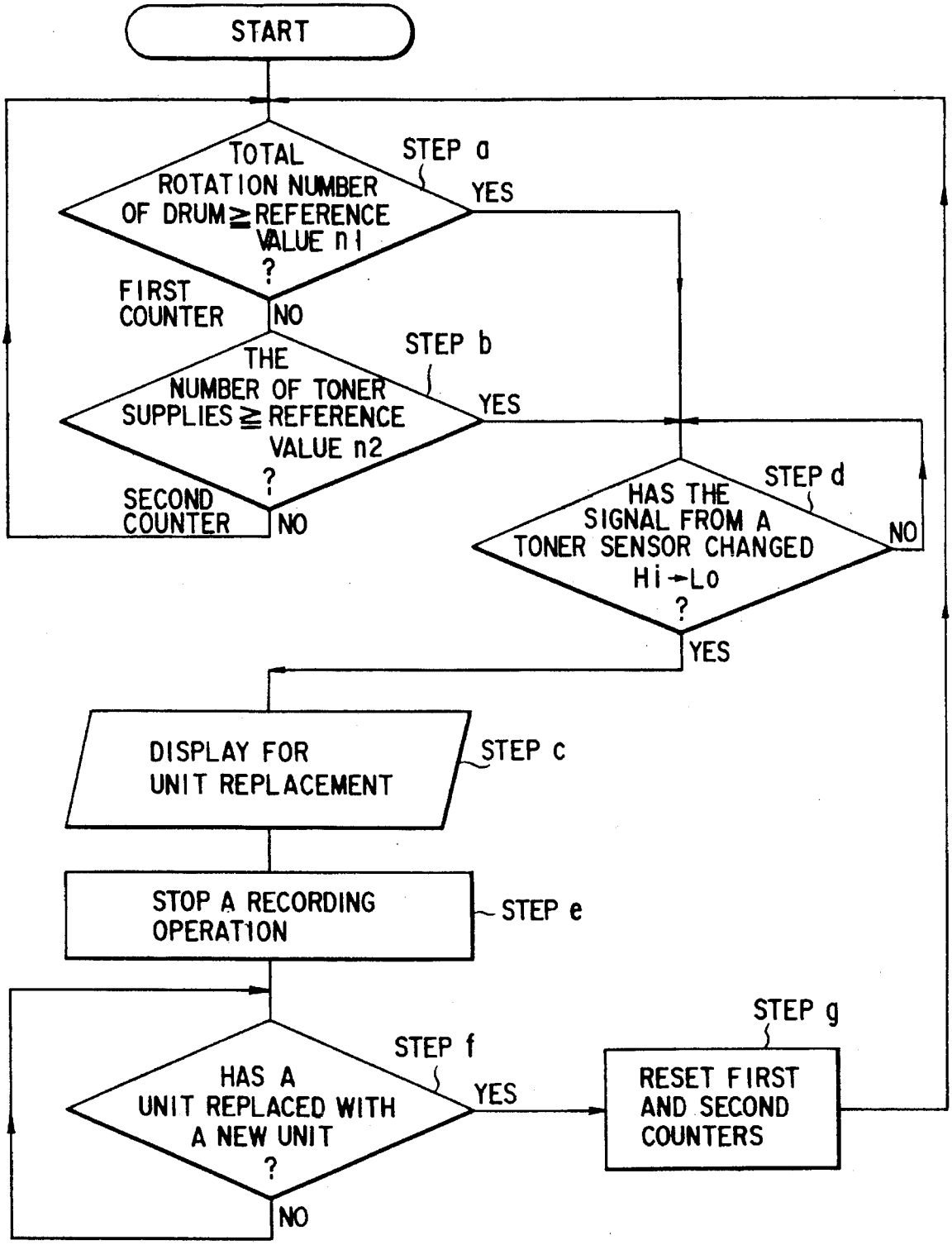
FIG. 7 shows a modified process of determination by a comparator.

The flow chart shown in FIG. 7 shows a variant of determining steps. The flow chart above is one obtained by adding additional steps to the determining process shown in FIG. 5. Put in another way, new determining steps d and f are added to the determining steps a and b as shown in the flow chart of FIG. 7. When the photosensitive member nearly reaches its own life limit and hence the value of the first counter becomes equal to the reference value n1, or in the case the value of the second counter becomes equal to the reference value n2. The amount of toner now present in the hopper is determined at the next step d, that is, it is determined whether or not an output signal coming from a toner sensor 34 has been changed from a "Hi"-level to a "Lo"-level. Only when the signal is changed to the "Lo"-level, a display emerges, prompting the user to replace the process unit with a new process unit at step c. In other circumstances, that is, when the photosensitive member reaches its life time limit but some unspent toner still remains available in the hopper, it may be possible to determine that, for some brief time period, the process unit continue being used for recording operation without making a warning display to that effect on the console display.

As indicated above, it may be possible to, immediately after a display to the effect that a process unit replacement is prompted (step c), forcibly stop a recording operation (step e), to, in the meantime, monitor (step f) whether or not the unit be replaced with a new one and to reset the counters 6 and 9 (step g), when the unit has been replaced, so that the step goes to an initial step of a given determination process.

As set out above, if it has been so designed that, when the comparator 10 determines that the process unit has reached its life limit, the implementation of an image recording (e.g. electrostatic recording) is inhibited (for example, stopped), it is easier to promptly replace the process unit to a new one and, even if any such replacement has not been made, the invention prevents the overflowing and clogging of a spent toner involved.

In the preceding embodiment, the process unit A comprises, as one unit, the photosensitive member equipped drum 1, charger 2, developing unit 2, cleaning unit 4 and discharger 5, but in an actual application it is only necessary that the process unit be so configured as to include at least two component parts: a photosensitive member and a spent toner holding section. As desired, the process unit may selectively include the developing unit 3.

In the preceding embodiment the total amount of use of the photosensitive member is counted as the number of times the photosensitive drum 1 has been rotated. However, the number of recording sheets that pass the photosensitive member, etc., can be utilized as the objects of counting, that is, as determining factors with which it is determined whether or not the photosensitive member has reached its life limit. Further the length of time for which the photosensitive member is exposed by the exposure unit B can be utilized in order to count the use of the photosensitive member.

In the preceding embodiment, the number of times the toner is supplied is counted based on a variation in the state of the toner sensor but it is also possible to monitor the state in which the toner cartridge is attached to and detached from the hopper, that is, to count the number of times the toner cartridge is attached to and detached from the hopper.

Although in the aforementioned embodiment the toner has been supplied from a new toner cartridge by way of example, a predetermined amount of toner may be supplied from, for example, a toner bottle so far as it is possible to supply a constant supply of the toner at all times from that bottle.

An electrostatic recording apparatus to which the image forming apparatus of the present invention is applied is not restricted to the facsimile equipment as set out above. Further, the present invention utilizing the process unit as set out above can be applied to those printer or copy machines including, for example, an LBP (laser beam printer) or a PPC (plane paper copier).

Various changes and modifications of the present invention can be made without departing from the spirit and scope of the present invention.

As set out above, it is possible, according to the present invention, to provide an image forming apparatus which, without the need to provide any bulkier apparatus as an electrostatic recording apparatus high in manufacturing and operational costs, utilizes a spent toner holding section to allow a replacement of a photosensitive drum to be carried out by checking whether or not the spent toner holding section is nearly fully filled with a spent toner, and initially prevents a drive system from being locked or broken due to an overflowing of such spent toner in the spent toner holding section. It is also possible to provide an image forming apparatus which ensures its low cost operation by reducing toner wastage to the lowest possible extent and ensures the use of one photosensitive member to its possible available limit of use.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

an image forming apparatus body:

a process unit detachably mounted on said body of the image forming apparatus and including a photosensitive member, a toner supplying section which supplies toner to the photosensitive member and to which a toner pack is detachably mounted, and a spent toner holding section for receiving spent toner from the photosensitive member, the photosensitive member, the toner supplying section, and the spent toner holding section being integral with the process unit so as to be removable together with the toner and the spent toner being sealed in the process unit when the process unit is detached from the body of the image forming apparatus;

first means for detecting whether or not said photosensitive member has reached its life limit;

second means for detecting whether or not said spent toner holding section has been filled with spent toner; and means for informing a user of an operating status of said process unit when said first means detects that said photosensitive member has reached its life limit or when said second means detects that said spent toner holding section has been filled with spent toner.

2. The image forming apparatus according to claim 1, wherein said operating status includes an indication that the process unit needs to be replaced with a new process unit.

3. The image forming apparatus according to claim 1, wherein said first means counts an amount of times that recording sheets pass said photosensitive member.

4. The image forming apparatus according to claim 1, wherein said second means counts a number of times that the toner is supplied to the image forming apparatus.

5. The image forming apparatus according to claim 1, further comprising means for generating a light which is modulated in accordance with a signal of an image to be recorded, wherein said second means cumulatively counts a length of time for which said photosensitive member is exposed with said generating means.

6. The image forming apparatus according to claim 1, further comprising detecting means for detecting whether or not there is at least a predetermined amount of toner to be used and wherein said second means counts a total amount of toner consumed based on a result of detection by said detecting means.

7. The image forming apparatus according to claim 6, wherein said first means counts the number of rotations of said photosensitive member by counting a predetermined number of reference pulse signals from a step motor serving as a drive source for rotationally driving said photosensitive member; and said second means counts, based on a given state of change of an output signal from a toner sensor, the number of times that a predetermined amount of toner is supplied to a toner storage section.

8. The image forming apparatus according to claim 1, wherein said informing means further determines whether or not an output signal coming from a toner sensor is varied from an output level of a first signal to an output level of a second signal and for, only when the output signal from said toner sensor is varied to the output level of the second signal, visually prompting the user to replace said process unit with a new process unit.

9. The image forming apparatus according to claim 8, wherein the informing means further stops a recording operation after the prompting of the process unit replacement.

10. The image forming apparatus according to claim 1, wherein said informing means further monitors whether or not said process unit has been replaced with a new process unit, and resets said first and second means when said process unit has been replaced.

11. The image forming apparatus according to claim 1, wherein said photosensitive member is a photosensitive drum and said first means counts a total number rotations of said photosensitive drum.

12. An image forming apparatus according to claim 1, in which said first means comprises means for counting a first total amount of use of said photosensitive member and means for comparing the first total amount with a first predetermined reference value, and said second means comprises means for counting a second total amount of toner consumed and means for comparing the second total amount with a second predetermined reference value.

13. The image forming apparatus according to claim 12, wherein when the first total amount matches the first predetermined reference value or the second total amount matches the second predetermined reference value, said determining means inhibits the image forming apparatus from recording an image until said process unit is replaced by a new process unit.

14. The image forming apparatus according to claim 12, wherein the second reference value is set to a predetermined value at which, when a toner supplied at a given number of times corresponding to the second reference value is all used up, said spent toner holding section is nearly fully filled with a spent toner and, said process unit is determined as having nearly reached its service life limit.

15. An image forming apparatus comprising:

a detachable process unit including an image bearing member, a toner supplying section which supplies toner to the image bearing member and to which a toner pack is detachably mounted, and a spent toner holding section for receiving spent toner from the image bearing member, the image bearing member, the toner supplying section, and the spent toner holding section being integral with said process unit so as to be removable together with the toner and the spent toner being sealed in the process unit when said process unit is detached from a body of the image forming apparatus;

first means for detecting whether or not said image bearing member has reached its life limit;

second means for detecting whether or not said spent toner holding section has been filled with spent toner; and means for determining the necessity for said process unit to be replaced with a new process unit when said first means detects that said image bearing member has reached its life limit or when said second means detects that said spent toner holding section has been filled with the spent toner.

16. An image forming apparatus according to claim 15, in which said first means comprises means for counting a first total amount of use of said photosensitive member and means for comparing the first total amount with a first predetermined reference value, and said second means comprises means for counting a second total amount of toner consumed and means for comparing the second total amount with a second predetermined reference value.

17. A process unit including:

a photosensitive member integral with a body of the process unit;

a spent toner holding section for receiving spent toner from said photosensitive member, the spent toner holding section being integral with the body of the process unit;

first means for detecting whether or not said photosensitive member has reached its life limit;

second means for detecting whether or not said spent toner holding section has been filled with spent toner; and means for informing a user of an operating status of said process unit when said first means detects that said photosensitive member has reached its life limit or when said second means detects that said spent toner holding section has been filled with spent toner.

18. An image forming apparatus according to claim 17, in which said first means comprises means for counting a first total amount of use of said photosensitive member and means for comparing the first total amount with a first predetermined reference value, and said second means comprises means for counting a second total amount of toner consumed and means for comparing the second total amount with a second predetermined reference value.

19. An image forming apparatus comprising:

a process unit including a photosensitive member integral with said process unit and a spent toner holding section integral with said process unit;

first means for detecting whether or not said photosensitive member has reached its life limit;

second means for detecting whether or not said spent toner section has been filled with spent toner; and means for informing a user of an operating status of said process unit when said first means detects that said photosensitive member has reached its life limit or when said second means detects that said spent toner section has been filled with spent toner.

20. An image forming apparatus according to claim 19, in which said first means comprises means for counting a first total amount of use of said photosensitive member and means for comparing the first total amount with a first predetermined said second means comprises means for counting a second total amount of toner consumed and means for comparing the second total amount with a second predetermined reference value.

* * * * *